United States Patent [19]

Kageyama et al.

[11] 4,365,390

[45] Dec. 28, 1982

[54] CLIP FOR WRITING UTENSIL

[75] Inventors: Hidehei Kageyama; Takahiko Suzuki, both of Saitama, Japan

[73] Assignee: Kotobuki & Co., Ltd., Saitama, Japan

[21] Appl. No.: 169,829

[22] Filed: Jul. 17, 1980

[30] Foreign Application Priority Data

Mar. 29, 1980 [JP] Japan ..... 55-41757[U]

[51] Int. Cl.[3] ..... B43K 25/00

[52] U.S. Cl. ..... 24/11 R; 24/11 F

[58] Field of Search ..... 24/11 R, 11 CC, 11 C, 24/11 CT, 11 FR, 11 PP, 11 F, 11 M, 11 P, 11 S

[56] References Cited

U.S. PATENT DOCUMENTS

| | | | |
|---|---|---|---|
| 2,075,932 | 4/1937 | Ehrmann | 24/11 CC X |
| 2,189,963 | 2/1940 | Schoneberger | 24/11 F |
| 3,453,694 | 7/1969 | Hechtle | 24/11 F |
| 3,608,154 | 9/1971 | Ira | 24/11 F |
| 3,842,466 | 10/1974 | Katz et al. | 24/11 F |

FOREIGN PATENT DOCUMENTS

| | | | |
|---|---|---|---|
| 2335211 | 11/1973 | Fed. Rep. of Germany | 24/11 R |
| 2532204 | 2/1975 | Fed. Rep. of Germany | 24/11 R |
| 1428677 | 1/1966 | France | 24/11 F |

*Primary Examiner*—Roy D. Frazier
*Assistant Examiner*—Peter A. Aschenbrenner
*Attorney, Agent, or Firm*—Bernard, Rothwell & Brown

[57] ABSTRACT

A clip for writing utensils such as a sharp pencil or the like comprising a clip piece including a pair of opposed insertion arms, said insertion arms being inserted into receiving grooves provided in side surfaces of a clip base formed integral with a holder of the writing utensil.

2 Claims, 7 Drawing Figures

CLIP FOR WRITING UTENSIL

BACKGROUND OF THE INVENTION

1. Field of the Invention

This invention relates to a clip for writing utensils such as a sharp pencil or the like.

2. Description of the Prior Art

In order to secure such kind of clip to a holder of the writing utensil, various complex constructions have heretofore been used in practice. As a result, such conventional clip has the disadvantage that it becomes complex in working and assembling.

SUMMARY OF THE INVENTION

An object of the invention, therefore, is to provide a clip for writing utensils which comprises a holder including a clip base made integral with the holder and provided at both side surfaces thereof with grooves with which is engaged a clip piece and which is easy in working and assembling.

A feature of the invention is the provision of a clip for writing utensils comprising a holder, a clip base made integral with the holder, and a clip piece secured to the clip base, said clip piece including a pair of insertion arms extending rearwardly from the rear end of the clip piece substantially parallel with each other and each provided at its surface with an engaging portion projected inwardly therefrom and said clip base being provided at its side surfaces with a pair of receiving grooves extending in a lengthwise direction of the clip base, whereby, when said insertion arms are inserted into said receiving grooves, said engaging portions are struck into the base surface of said receiving grooves so as to firmly secure said clip piece to said clip base.

Further objects and features of the invention will be fully understood from the following detailed description with reference to the accompanying drawings.

DETAILED DESCRIPTION OF THE PREFERRED EMBODIMENTS

Figure 1:
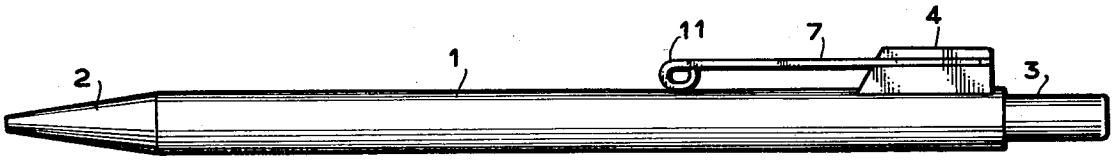
FIG. 1 is a side elevational view of one embodiment of a clip for writing utensils according to the invention.
Figure 2:
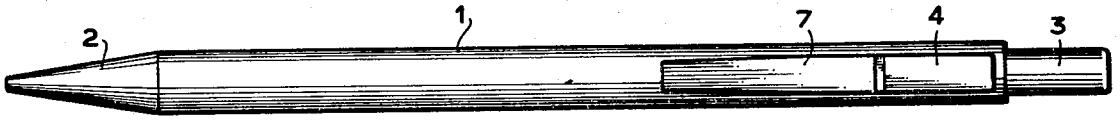
FIG. 2 is its plan view.

FIGS. 1 to 4 show one embodiment of a clip for writing utensils according to the invention. In FIGS. 1 to 4, reference numeral 1 designates a holder of a writing utensil such as a sharp pencil. The holder 1 is provided at its front end with a cap 2 threadedly engaged with the holder 1 and at its rear end with a knock portion 3. The holder 1 is provided at its rear portion with a frustum-shaped clip base 4 made integral with the holder 1 and extending along the outer periphery in a lengthwise direction of the holder 1. The clip base 4 is provided at its both side surfaces with a pair of receiving grooves 5, 5 extending in a lengthwise direction of the holder 1.

Reference numeral 7 designates a clip piece composed, for example, of a metal sheet. The clip piece 7 is provided at its one end with a rectangular cut 10 to form a pair of opposed insertion arms 8, 8. The other end of the clip piece 7 is wound into a roll urged against the holder 1.

Figure 3:
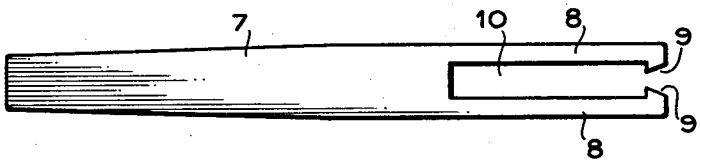
FIG. 3 is a plan view of a clip piece of the clip shown in FIG. 1.

As clearly shown in FIG. 3, the insertion arms 8, 8 extend rearwardly from the rear end of the clip piece 7 substantially parallel with each other. The insertion arms 8, 8 are spaced apart from each other by a distance which is substantially equal to the distance between the base surfaces of the receiving grooves 5, 5 provided in the side surfaces of the clip base 4. Each insertion arm 8 is provided at its front end with a hook-shaped engaging portion 9 projected inwardly.

In the clip constructed as above described, when the insertion arms 8, 8 of the clip sheet 7 are inserted into the front ends of the receiving grooves 5, 5 of the clip base 4 and slidably moved backwardly in the lengthwise direction of the clip base 4, it is possible to fit the clip piece 7 to the clip base 4. When the insertion arms 8, 8 arrive at their given position, each engaging hook projected inwardly from the front end of the insertion arm 8 is struck into the base surface of each receiving grooves to form a depression 6 as shown in FIG. 4, and as a result, the clip piece 7 is reliably secured to the clip base 4.

Figure 6:
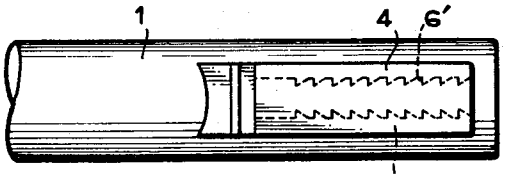
FIG. 6 is a plan view of a clip base corresponding to the clip piece shown in FIG. 5.
Figure 5:
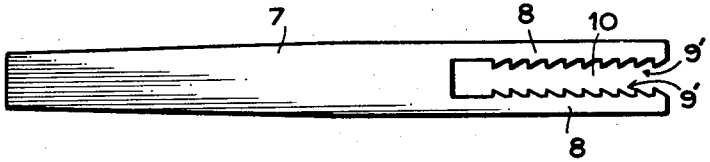
FIG. 5 is a plan view of another embodiment of a clip piece according to the invention.

Each insertion arm 8 may be provided at its inner surface with a plurality of saw-tooth shaped indentations 9', as shown in FIG. 5. In this case, when the insertion arm 8, 8 are inserted into the receiving grooves 5, 5, depressions 6', shown in FIG. 6, corresponding to the saw-tooth shaped indentations 9' are formed in the base surface of the receiving groove 5 of the clip base 4. As a result, the clip piece 7 engages through a number of indentations 9' with the clip base 4, so that the clip piece 7 is more reliably secured to the clip base 4.

Figure 4:
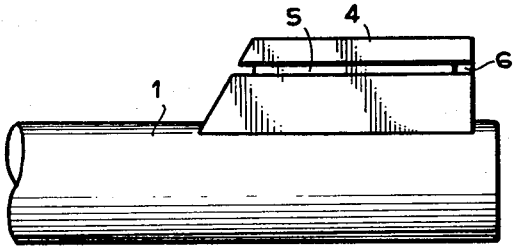
FIG. 4 is a side elevational view of a clip base shown in FIG. 1.
Figure 7:
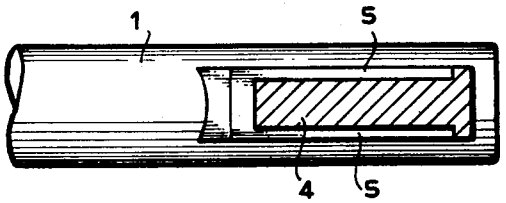
FIG. 7 is a plan view of a further embodiment of a clip base according to the invention, partly shown in section.

As shown in FIG. 4, the rear end of the receiving groove 5 provided in the clip base 4 is made open. Alternatively, the rear end of the receiving groove 5 may be closed by the rear end of the clip base 4 as shown in FIG. 7. In this case, the rear ends of the insertion arms 8, 8 are hidden by the rear end of the clip base 4, thereby improving a design of appearance.

As stated hereinbefore, the invention is capable of inserting the clip piece into the clip base made integral with the holder and hence of securing the clip piece to the holder in an easy and reliable manner, thereby remarkably simplifying the clip in working and assembling.

What is claimed is:

1. A clip for writing utensils comprising a holder, a clip base made integral with said holder and projecting laterally therefrom, said clip base including aligned grooves in opposite faces thereof extending lengthwise of said clip base, said grooves being spaced from said holder and extending substantially parallel thereto, a clip piece secured to said clip base, said clip piece including a pair of insertion arms extending substantially parallel with each other, said arms being slidably received in said grooves for assembly with said clip base, each of said arms being provided at its inside surface with an engaging portion having saw-tooth shaped indentations, said engaging portions being struck into the base surface of each of said grooves after assembly on said clip base, to form depressions in said base surfaces so as to firmly secure said clip piece to said clip base.

2. The clip according to claim 1, wherein said grooves are closed at their rear ends for concealing said ends of said grooves and the ends of said arms.

* * * * *

UNITED STATES PATENT OFFICE

CERTIFICATE OF CORRECTION

Patent No. 4,365,390 Dated December 28, 1982

Inventor(s) Hidehei Kageyama and Takahiko Suzuki

It is certified that error appears in the above-identified patent and that said Letters Patent are hereby corrected as shown below:

Column 1, line 27, after the word "its" insert the word --inside--.

Column 2, line 5, after the word "roll" insert --11--.

Signed and Sealed this

First Day of March 1983

[SEAL]

*Attest:*

GERALD J. MOSSINGHOFF

*Attesting Officer*

*Commissioner of Patents and Trademarks*